US010347271B2

(12) United States Patent
Nesta et al.

(10) Patent No.: US 10,347,271 B2
(45) **Date of Patent: *Jul. 9, 2019**

(54) SEMI-SUPERVISED SYSTEM FOR MULTICHANNEL SOURCE ENHANCEMENT THROUGH CONFIGURABLE UNSUPERVISED ADAPTIVE TRANSFORMATIONS AND SUPERVISED DEEP NEURAL NETWORK

(71) Applicant: SYNAPTICS INCORPORATED, San Jose, CA (US)

(72) Inventors: Francesco Nesta, Irvine, CA (US); Xiangyuan Zhao, Lubbock, TX (US); Trausti Thormundsson, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/368,452

(22) Filed: Dec. 2, 2016

(65) Prior Publication Data

US 2017/0162194 A1 Jun. 8, 2017

Related U.S. Application Data

(60) Provisional application No. 62/263,558, filed on Dec. 4, 2015.

(51) Int. Cl.
*G10L 25/78* (2013.01)
*H04R 3/00* (2006.01)
(Continued)

(52) U.S. Cl.
CPC ..... *G10L 21/0208* (2013.01); *G10L 25/30* (2013.01); *G10L 21/0216* (2013.01);
(Continued)

(58) Field of Classification Search
CPC . G10L 25/78; G10L 21/0208; G10L 21/0216; H04R 3/005
(Continued)

(56) References Cited

U.S. PATENT DOCUMENTS 7,809,145 B2 * 10/2010 Mao ..... H04R 3/005 381/122
9,008,329 B1 * 4/2015 Mandel ..... G10K 15/00 381/71.1
(Continued)

*Primary Examiner* — Farzad Kazeminezhad
(74) *Attorney, Agent, or Firm* — Haynes and Boone, LLP

(57) ABSTRACT

Various techniques are provided to perform enhanced automatic speech recognition. For example, a subband analysis may be performed that transforms time-domain signals of multiple audio channels in subband signals. An adaptive configurable transformation may also be performed to produce single or multichannel-based features whose values are correlated to an Ideal Binary Mask (IBM). An unsupervised Gaussian Mixture Model (GMM) model fitting the distribution of the features and producing posterior probabilities may also be performed, and the posteriors may be combined to produce deep neural network (DNN) feature vectors. A DNN may be provided that predicts oracle spectral gains from the input feature vectors. Spectral processing may be performed to produce an estimate of the target source time-frequency magnitudes from the mixtures and the output of the DNN. Subband synthesis may be performed to transform signals back to time-domain.

19 Claims, 7 Drawing Sheets

(51) Int. Cl.

| | |
|---|---|
| ***G10L 21/0216*** | (2013.01) |
| ***G10L 21/0208*** | (2013.01) |
| ***G10L 25/30*** | (2013.01) |
| *G10L 21/0272* | (2013.01) |

(52) U.S. Cl.
CPC ..... *G10L 21/0272* (2013.01); *G10L 25/78* (2013.01); *G10L 2021/02087* (2013.01); *G10L 2021/02166* (2013.01); *H04R 3/005* (2013.01)

(58) Field of Classification Search
USPC ..... 704/232, 226; 381/122
See application file for complete search history.

(56) References Cited

U.S. PATENT DOCUMENTS

| | | | | |
|---|---|---|---|---|
| 9,640,194 | B1 * | 5/2017 | Nemala | G10L 21/0208 |
| 2010/0057453 | A1 * | 3/2010 | Valsan | G10L 25/78<br>704/232 |
| 2012/0239392 | A1 * | 9/2012 | Mauger | G10L 21/0216<br>704/226 |

* cited by examiner

SEMI-SUPERVISED SYSTEM FOR MULTICHANNEL SOURCE ENHANCEMENT THROUGH CONFIGURABLE UNSUPERVISED ADAPTIVE TRANSFORMATIONS AND SUPERVISED DEEP NEURAL NETWORK

CROSS-REFERENCE TO RELATED APPLICATION

The present application claims priority to U.S. provisional patent application No. 62/263,558, filed Dec. 4, 2015, which is fully incorporated by reference as if set forth herein in its entirety.

TECHNICAL FIELD

The present invention relates generally to audio source enhancement and, more particularly, to multichannel configurable audio source enhancement.

BACKGROUND

For audio conference calls and for applications requiring automatic speech recognition (ASR), speech enhancement algorithms are generally employed to improve the quality of the service. While high background noise can reduce the intelligibility of the conversation in an audio call, interfering noise can drastically degrade the accuracy of automatic speech recognition.

Among many proposed approaches to improve recognition, multichannel speech enhancement based on beamforming or demixing has shown to be a promising method due to the inherent ability to adapt to the environmental conditions and suppress non-stationary noise signals. Nevertheless, the ability of multichannel processing is often limited by the number of observed mixtures and by the reverberation which reduces the separability between target speech and noise in the spatial domain.

On the other hand, various single channel methods based on supervised machine-learning systems have also been proposed. For example, non-negative matrix factorization and neural networks have shown to be the most promising successful approaches to data-dependent supervised single channel speech enhancement. Although unsupervised spatial processing makes few assumptions regarding the spectral statistic of the speech and noise sources, supervised processing requires prior training on similar noise conditions in order to learn the latent invariant spectro-temporal factors composing the mixture in their time-frequency representation. The advantage of the first is that it does not require any specific knowledge on the source statistic and it exploits only the spatial diversity of the mixture which is intrinsically related to the position of each source in the space. On the other hand, the supervised methods do not rely on the spatial distribution and therefore they are able to separate speech in diffuse noise, where the noise spatial distribution highly overlaps that of the target speech.

One of the main limitations on data-based enhancement is the assumption that the machine learning system learns invariant factors from the training data which will be observed also at test time. However, the spatial information is not invariant by definition since it is related to the position of the acoustic sources which may vary over time.

The use of a deep neural network (DNN) for source enhancement has been proposed in various literature, such as: Jonathan Le Roux, John R. Hershey, Felix Weninger, "Deep NMF for Speech Separation," in Proc. ICASSP 2015 International Conference on Acoustics, Speech, and Signal Processing, April 2015; Huang, Po-Sen, et al., "Deep learning for monaural speech separation," Acoustics, Speech and Signal Processing (ICASSP), 2014 IEEE International Conference on. IEEE, 2014; Weninger, Felix, et al., "Discriminatively trained recurrent neural networks for single channel speech separation," Signal and Information Processing (GlobalSIP), 2014 IEEE Global Conference on. IEEE, 2014; and Liu, Ding, Paris Smaragdis, and Minje Kim, "Experiments on deep learning for speech denoising," Proceedings of the annual conference of the International Speech Communication Association (INTERSPEECH), 2014.

However, such literature focuses on the learning of discriminative spectral structures to identify and extract speech from noise. The neural net training (either for the DNNs or for the recurrent networks) is carried out by minimizing the error between the predicted and ideal oracle time-frequency masks or, in the alternative, by minimizing the error between the reconstructed masked speech and the clean reference. The general assumption is that at training time the DNN will encode some information related to the speech and noise which is invariant over different datasets and therefore could be used to predict the right gains at the test time.

Nevertheless, there are practical limitations for real-world applications of such "black-box" approaches. First, the ability of the network to discriminate speech from noise is intrinsically determined by the nature of the noise. If the noise is of speech nature, its time-spectral representation will be highly correlated to the target speech and the enhancement task is by definition ambiguous. Therefore, the lack of separability of the two classes in the feature domain will not permit a general network to be trained to effectively discriminate between them, unless done by overfitting the training data which does not have any practical usefulness. Second, in order to generalize to unseen noise conditions, a massive data collection is required and a huge network is needed to encode all the possible noise variations. Unfortunately, resource constraints can render such approaches impractical for real-world low footprint and real-time systems.

Moreover, despite the various techniques proposed in the literature, large networks are more prone to overfit the training data without learning useful invariant transformation. Also, for commercial applications, the actual target speech may depend on specific needs which could be set on the fly by a configuration script. For example, a system might be configured to extract a single speaker in a particular spatial region or having some specific ID (e.g., by using speaker ID identification), while cancelling any other type of noise including other interfering speakers. In another modality, the system might be configured to extract all the speech and cancel only non-speech type noise (e.g., for a multi-speaker conference call scenario). Thus, different application modalities could actually contradict to each other and a single trained network cannot be used to accomplish both tasks.

SUMMARY

In accordance with embodiments set forth herein, various techniques are provided to efficiently combine multichannel configurable unsupervised spatial processing with data-based supervised processing, thus providing the advantages of both approaches. In some embodiments, blind multichannel adaptive filtering is performed in a preprocessing stage to generate features which are averagely invariant on the position of the source. The first stage can include configurable prior-domain knowledge which can be set at test time without the need of a new data-based retraining stage. This generates invariant features which are provided as inputs to a deep neural network (DNN) which is trained discriminatively to separate speech from noise by learning a predefined prior dataset. In some embodiments, this combination is tightly correlated to the matched training. Instead of using the default acoustic models learned from clean speech data, ASR are generally matched to the processing by retraining the models on the training data preprocessed by the enhancement system. The effect of the retraining is that of compensating for the average statistical deviation introduced by the preprocessing in the distribution of the features. By training DNN to predict oracle spectral gains from distorted ones, the system may learn and compensate for the typical distortion produced by the unsupervised filters. From another point of view, the unsupervised learning acts as a multichannel feature transformation which makes the DNN input data invariant in the feature domain.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
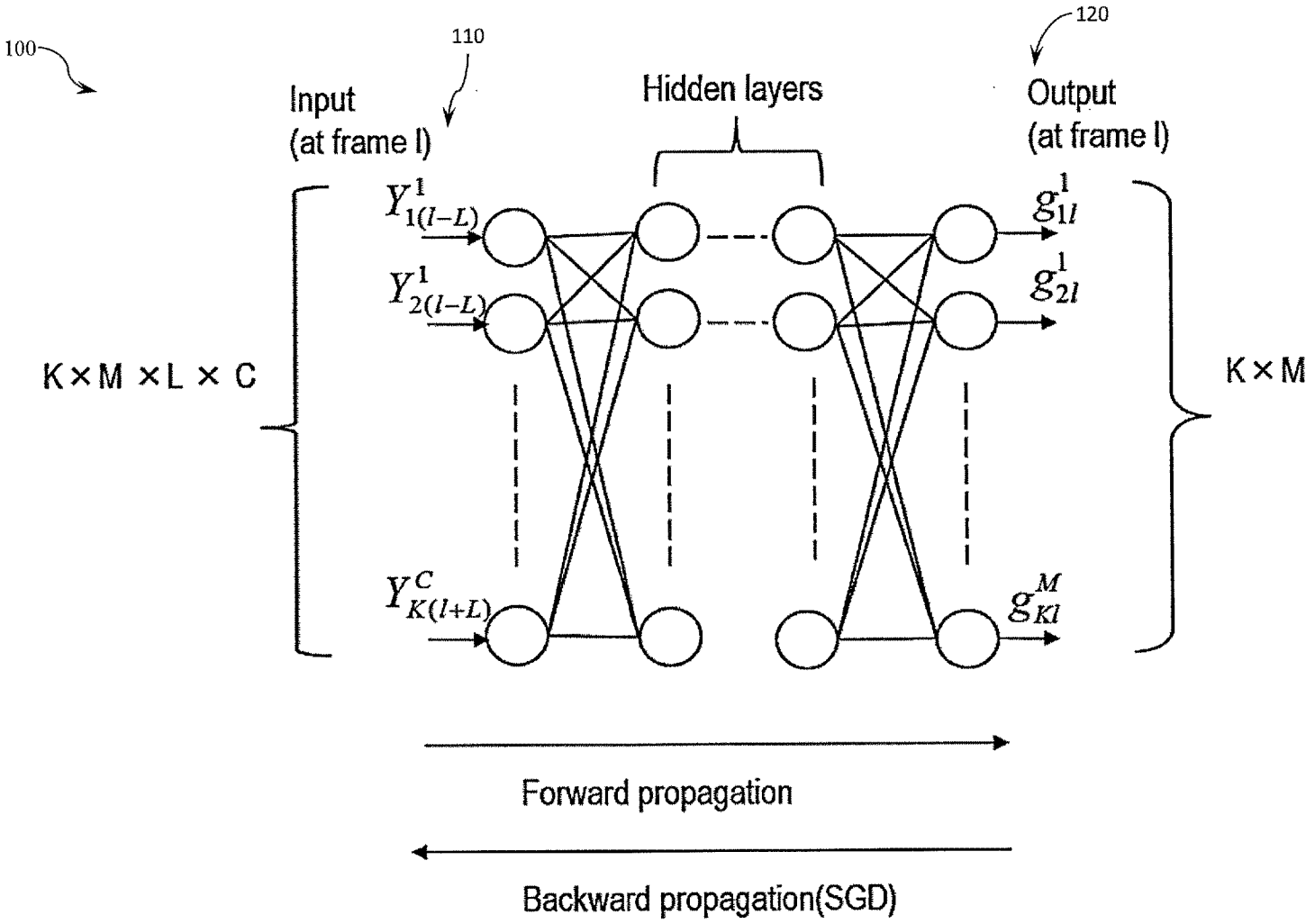
FIG. 1 illustrates a graphical representation of a deep neural network (DNN) in accordance with an embodiment of the disclosure.

In accordance with various embodiments, systems and methods are provided to improve automatic speech recognition that combine multichannel configurable unsupervised spatial processing with data-based supervised processing. As further discussed herein, such systems and methods may be implemented by one or more systems which may include, in some embodiments, one or more subsystems (e.g., modules to perform task-specific processing) and related components as desired.

In some embodiments, a subband analysis may be performed that transforms time-domain signals of multiple audio channels into subband signals. An adaptive configurable transformation may also be performed to produce single or multichannel-based features whose values are correlated to an Ideal Binary Mask (IBM). An unsupervised Gaussian Mixture Model (GMM) model fitting the distribution of the features and producing posterior probabilities may also be performed, and the posteriors may be combined to produce DNN feature vectors. A DNN (e.g., also referred to as a multi-layer perceptron network) may be provided that predicts oracle spectral gains from the input feature vectors. Spectral processing may be performed to produce an estimate of the target source time-frequency magnitudes from the mixtures and the output of the DNN. Subband synthesis may be performed to transform signals back to time-domain.

The combined techniques of the present disclosure provide various advantages, particularly when compared to conventional ASR techniques. For example, in some embodiments, the combined techniques may be implemented by a general framework that can be adapted to multiple acoustic scenarios, can work with single channel or with multichannel data, and can better generalize to unseen conditions compared to a naive DNN spectral gain learning based on magnitude features. In some embodiments, the combined techniques can disambiguate the goal of the task by proper definition of the scenario parameters at test time and does not require a different DNN model for each scenario (e.g., a single multi-task training coupled with the configurable adaptive transformation is sufficient for training a single generic DNN model). In some embodiments, the combined techniques can be used at test time to accomplish different tasks by redefining the parameters of the adaptive transformation without requiring new training. Moreover, in some embodiments, the disclosed techniques do not rely on the actual mixture magnitude as main input feature for the DNN but on general characteristics which are invariant across different acoustic scenarios and application modalities.

In accordance with various embodiments, the techniques of the present disclosure may be applied to a multichannel audio environment receiving audio signals from multiple sources (e.g., microphones and/or other audio inputs). For example, considering a generic multichannel recording setup, s(t) and n(t) may identify the (sampled) multichannel images of the target source signal and the noise recorded at the microphones, respectively:

$$s(t)=[s_1(t), \ldots, s_M(t)]$$

$$n(t)=[n_1(t), \ldots, n_M(t)]$$

where M is the number of microphones. The observed multichannel mixture recorded at the microphones can be modeled as superimposition of both components as $$x(t)=s(t)+n(t).$$

In various embodiments, s(t) may be estimated given observations of x(t). These components may be transformed in a discrete time-frequency representation as $$X(k,l)=F[x(t)], S(k,l)=F[s(t)], N(k,l)=F[n(t)]$$

where F indicates the transformation operator and k,l indicate the subband index (or frequency bin) and the discrete time frame, respectively. In some embodiments, a Short-time-Fourier Transform may be used. In other embodiments, more sophisticated analysis methods may be used such as wavelets or quadrature subband filterbanks. In this domain, the clean source signal at each channel can be estimated by multiplying the magnitude of the mixture by a real-valued spectral gain g(k,l)

$$\hat{S}_m(k,l)=g_k(l)X_m(k,l).$$

A typical target spectral gain is the ideal ratio mask (IRM) defined as $$IRM_m(k,l)=\frac{|S_m(k,l)|}{|S_m(k,l)|+|N_m(k,l)|}$$

which produces a high improvement in intelligibility when applied to speech enhancement problems. Such gain formulation neglects the phase of the signals and it is based on the implicit assumption that if the sources are uncorrelated the mixture magnitude can be approximated as $$|X(k,l)|\approx|S(k,l)|+|N(k,l)|.$$

If the sources are sparse enough in the time-frequency (TF) representation, an efficient alternative mask may be provided by the Ideal Binary Mask (IBM) which is defined as $$IBM_m(k,l)=1,\ \text{if}\ |S_m(k,l)|>LC\cdot|N_m(k,l)|,\ IBM_m(k,l)=0,\ \text{otherwise}$$

where LC is the local signal to noise ratio (SNR) threshold, usually set to 0 dB. Supervised machine-learning-based enhancement methods target the estimation of the IRM or IBM by learning transformations to produce clean signals from a redundant number of noisy examples. Using large datasets where the target signal and the noise are available individually, oracle masks are generated from the data as in equations 5 and 7.

In various embodiments, a DNN may be used as a discriminative modeling framework to efficiently predict oracle gains from examples. In this regard, $\grave{g}(l)=[g_1^1(l),\ldots,g_K^M(l)]$ may be used to represent the vector of spectral gains of each channel learned for the frame 1, and with X(1) being the feature vector representing the signal mixture at instant l, i.e., $X(l)=[X_1(\mathbf{1},l),\ldots,X_M(K,l)]$. In a generic DNN model, the output gains are predicted through a chain of linear and non-linear computations as $$\hat{g}(l)=h_0(W_D h_D(W_{D-1}\ldots h_1(W_1[W(l);1])))$$

where $h_d$ is an element-wise non-linearity and $w_d$ is the weighting matrix for the dth layer. In general, the parameters of a DNN model are optimized in order to minimize the prediction error between the estimated spectral gains and the oracle one $$e=\sum_l f[\hat{g}(l),g(l)]$$

where g(l) indicates the vector of oracle spectral gains which can be estimated as in equations 5 or 7, and f(•) is a generic differentiable error metric (e.g., the mean square error). Alternatively, the DNN can be trained to minimize the signal approximation error $$e=\sum_l f[\hat{g}(l)\circ X(l),S(l)]$$

where ○ is the element-wise dot product. If f(•) is chosen to be the mean square error, equation 10 would optimize the Signal to Distortion Ratio (SDR) which may be used to assess the performance of signal enhancement algorithms.

Generally, in supervised approaches to speech enhancement, it is implicitly assumed that what is the target source and what is the unwanted noise is well and unambiguously defined at the training stage. However, this definition is task dependent which implies that a new training may be needed for any new application scenario.

For example, if the goal is to suppress non-speech noise type from noisy speech, the DNN may be trained with oracle noise signal examples not containing any speech (e.g., for speech enhancement in car, for multispeaker VoIP audio conference applications, etc.). On the other hand, if the goal is to extract the dominant speech from background noise including competing speakers, the noise signal sequences may also contain examples of interfering speech. While the example-based learning can lead to a very powerful and robust modeling, it also limits the configurability of the overall enhancement system. The fully supervised training implies that a different model would need to be learned for each application modality through the use of ad-hoc definition of a new training dataset. However, this is not a scalable approach for generic commercial applications where the used modality could be defined and configured at test time.

The above-noted limitations of DNN approaches may be overcome in accordance with various embodiments of the present disclosure. In this regard, an alternative formulation of the regression may be used. The IBM in equation 7 can provide an elegant, yet powerful approach to enhancement and speech intelligibility improvement. In ideal sparse conditions, binary masks can be seen as binarized target source presence probabilities. Therefore, the enhancement problem can be formulated as estimating such probabilities rather than the actual magnitudes. In this regard, an adaptive system transformation S(•) may be used which maps X(k,l) to a new domain $L_{kl}$ according to a set of user defined parameters Λ:

$$L_{kl}=S[X(k,l),\Lambda]$$

The parameters Λ define the physical and semantic meaning for the overall enhancement process. For example, if multiple channels are available, processing may be performed to enhance the signals of sources in a specific spatial region. In this case, the parameter vector may include all the information defining the geometry of the problem (e.g., microphone spacing, geometry of the region, etc.). On the other hand, if processing is performed to enhance speech in any position while removing stationary background noise at a certain SNR, then the parameter vector may also include expected SNR levels and temporal noise variance.

In some embodiments, the adaptive transformation is designed to produce discriminative output features $L_{kl}$ whose distribution for noise and target source dominated TF points mildly overlap and is not dependent on the task-related parameters Λ. For example, in some embodiments, $L_{kl}$ may be a spectral gain function designed to enhance the target source according to the parameters Λ and the used adaptive model.

Because of the sparseness of the target and noise sources in the TF domain, a spectral gain will correlate with the IBM if the adaptive filter and parameters are well designed. However, in practice, the unsupervised learning may not provide a reliable estimate for the IBM because of intrinsic limitations of the underlying model and of the cost function used for the adaptation. Therefore, the DNN may be used in the later stage to equalize the unsupervised prediction (e.g., by learning a global data-dependent transformation). The distribution of the features $L_{kl}$ in each TF point is first learned with unsupervised learning by fitting the observations to a Gaussian Mixture Model (GMM)

$$p_{kl} = \sum_{i=1}^{C} w_{kl}^{i} \cdot N[\mu_{kl}^{i}, \sigma_{kl}^{i}]$$

where $N[\mu_{kl}^{i}, \sigma_{kl}^{i}]$ is a Gaussian distribution with parameters $\mu_{kl}^{i}$ and $\sigma_{kl}^{i}$, and $w_{kl}^{i}$ the weight of the ith component of the mixture model. In some embodiments, the parameters of the GMM model can be updated on-line with a sequential algorithm (e.g., in accordance with techniques set forth in U.S. patent application Ser. No. 14/809,137 filed Jul. 24, 2015 and U.S. Patent Application No. 62/028,780 filed Jul. 24, 2014, all of which are hereby incorporated by reference in their entirety). Then, after reordering the components according to the estimates, a new feature vector is defined by encoding the posterior probability of each component, given the observations $L_{kl}$ $$p_{kl}^{c} = \frac{w_{kl}^{c} \cdot p(L_{kl} \mid \mu_{kl}^{c}, \sigma_{kl}^{c})}{\sum_i w_{kl}^{i} \cdot p(L_{kl} \mid \mu_{kl}^{i}, \sigma_{kl}^{i})}, \; p_k^l = [p_{kl}^{1}, \ldots, p_{kl}^{C}]$$

where $p(L_{kl} | \mu_{kl}^{c}, \sigma_{kl}^{c})$ is the Gaussian likelihood of the component c, evaluated in $L_{kl}$. The estimated posteriors are then combined in a single super vector which becomes the new input of the DNN $$Y(l)=[p_1^{l-L}, \ldots p_K^{l-L}, \ldots p_1^{l+L}, \ldots p_K^{l+L}]$$

Referring now to the drawings, FIG. 1 illustrates a graphical representation of a DNN 100 in accordance with an embodiment of the disclosure. As shown, DNN 100 includes various inputs 110 (e.g., supervector) and outputs 120 (e.g., gains) in accordance with the above discussion.

In some embodiments, the supervector corresponding to inputs 110 may be more invariant than the magnitude with respect to different application scenarios, as long as the adaptive transformation provides a compress representation for the features $L_{kl}$. As such, the DNN 100 may not learn the distribution of the spectral magnitudes but that of the posteriors which encode the discriminability between target source and noise in the domain spanned by the adaptive features. Therefore, in a single training it is possible to encode the statistic of the posteriors obtained for multiple user case scenarios which permit the use of the same DNN 100 at test time for multiple tasks by configuring the adaptive transformation. In other words, the variability produced by different application scenarios may be effectively absorbed by the model-based adaptive system and the DNN 100 learns how to equalize the spectral gain prediction of the unsupervised model by using a single task-invariant model.

Figure 2:
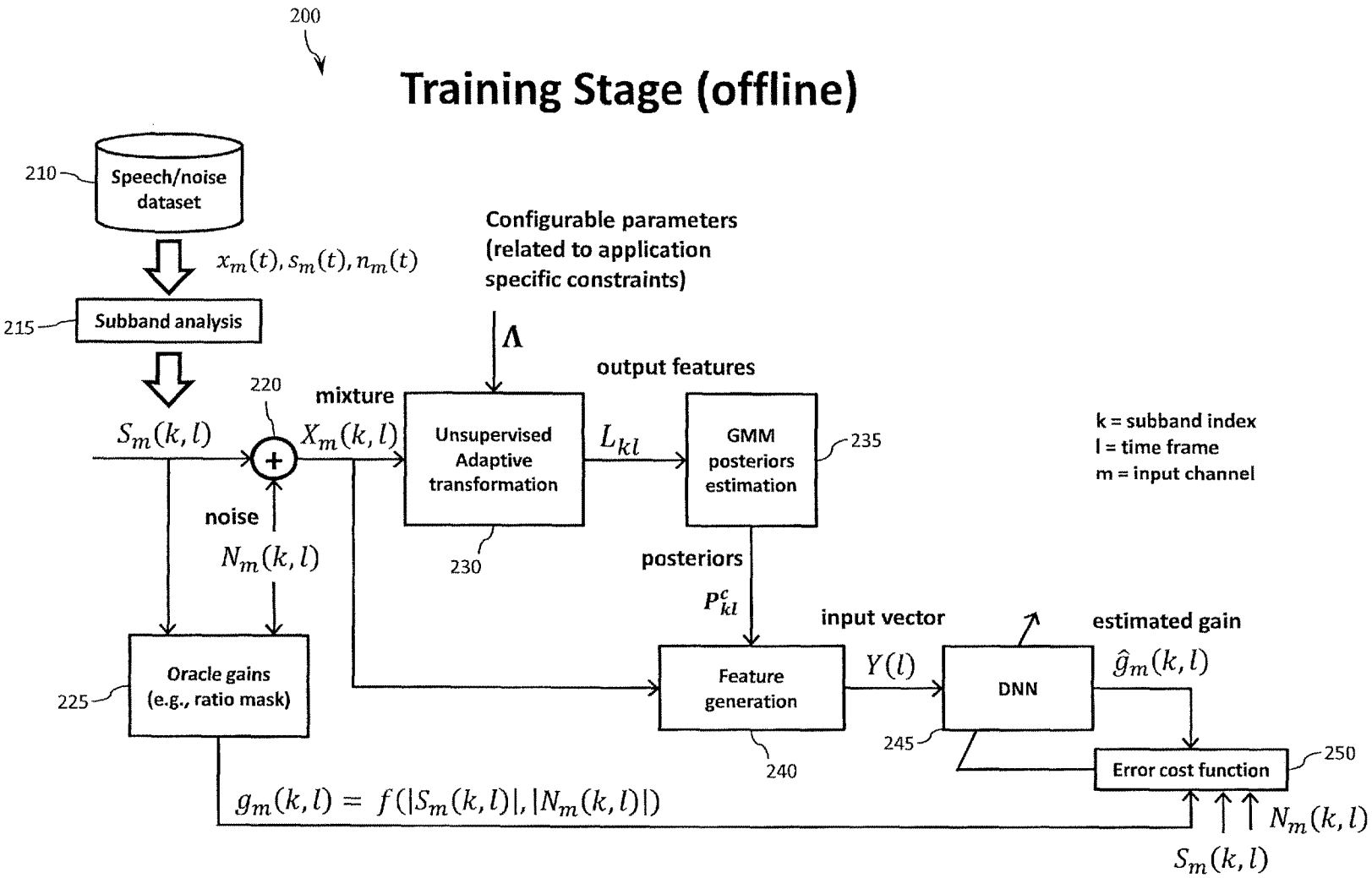
FIG. 2 illustrates a block diagram of a training system in accordance with an embodiment of the disclosure.
Figure 3:
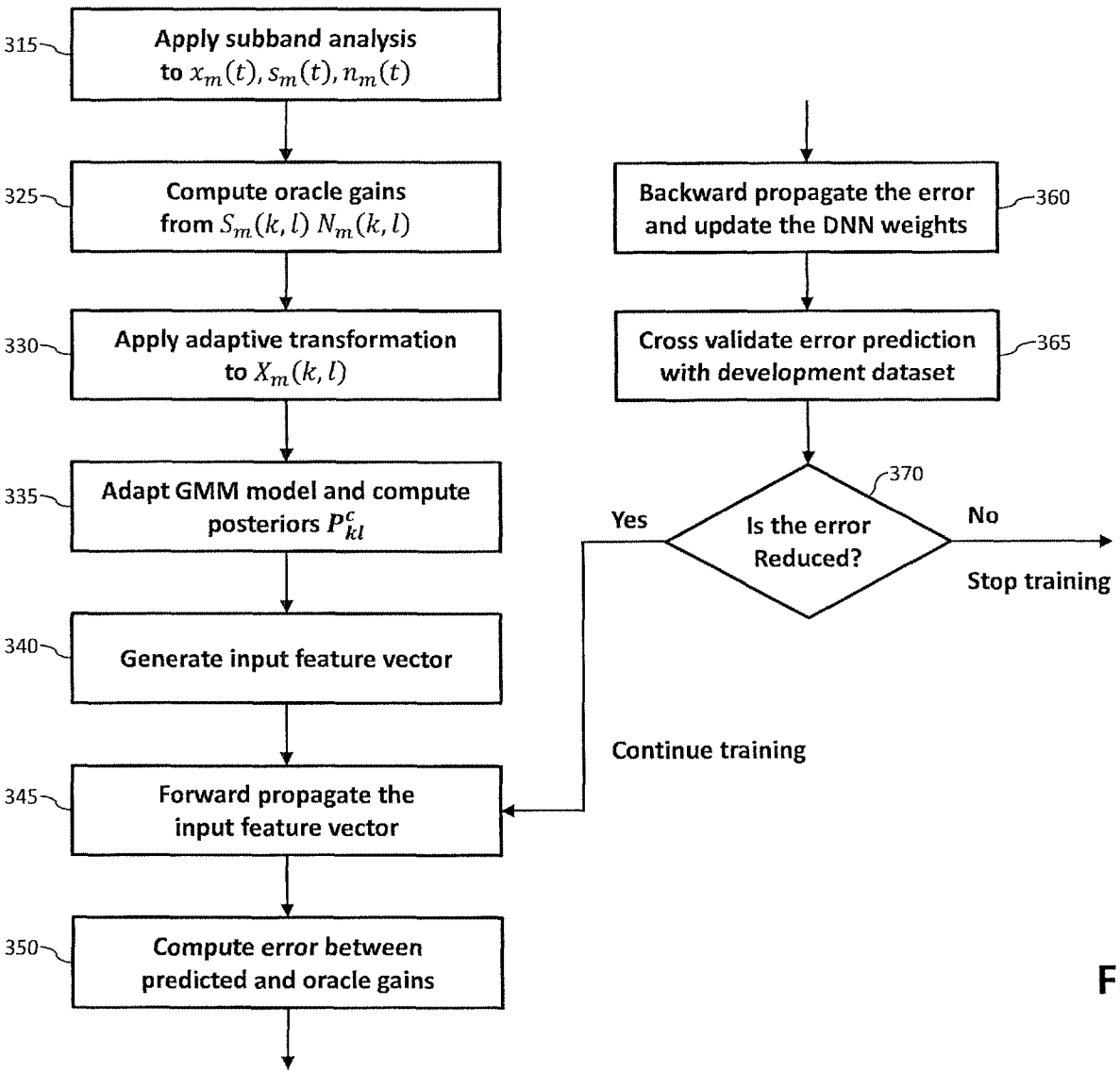
FIG. 3 illustrates a process performed by the training system of FIG. 2 in accordance with an embodiment of the disclosure.

FIG. 2 illustrates a block diagram of a training system 200 in accordance with an embodiment of the disclosure, and FIG. 3 illustrates a process 300 performed by the training system 200 of FIG. 2 in accordance with an embodiment of the disclosure.

In general, at train time, multiple application scenarios may be defined and multiple configurable parameters may be selected. In some embodiments, the definition of the training data does not have to be exhaustive but should be wide enough to cover user modalities which have contradictory goals. For example, a multichannel system can be used in a conference modality where multiple speakers need to be extracted from the background noise. At the same time, it can also be used to extract the most dominant source localized in a specific region of the space. Therefore, in some embodiments, examples of both cases may be provided if at test time both working modalities are available for the user.

In some embodiments, the unsupervised configurable system is run on the training data in order to produce the source dominance probability $P_k^l$. The oracle IBM is estimated from the training data and the DNN is trained to minimize the prediction error given the feature Y(l).

Referring now to FIG. 2, training system 200 includes a speech/noise dataset 210 and performs a subband analysis on the dataset (block 215). In one embodiment, the speech/noise dataset 210 includes multichannel, time-domain audio signals and the subband analysis block 215 transforms the time-domain audio signals to under-sampled K subband signals. The results of the subband analysis are combined (block 220) with oracle gains (block 225). The resulting mixture is provided to blocks 230 and 240.

In block 230, an unsupervised adaptive transformation is performed on the resulting mixture from block 220 and is configured by user defined parameters Λ. The resulting output features undergo a GMM posteriors estimation as discussed (block 235). In block 240, the DNN input vector is generated from the posteriors and the mixture from block 220.

In block 245, the DNN (e.g., corresponding to DNN 100 in some embodiments) produces estimated gains which are provided along with other parameters to block 250 where an error cost function is determined. As shown, the results of the error cost function are fed back into the DNN.

Referring now to FIG. 3, process 300 includes a flow path with blocks 315 to 350 generally corresponding to blocks 215 to 250 of FIG. 2. In block 315, a subband analysis is performed. In block 325, oracle gains are calculated. In block 330, an adaptive transformation is applied. In block 335, a GMM model is adapted and posteriors are calculated. In block 340, the input feature vector is generated. In some embodiments, the process of FIG. 3 may continue to block 345 or stop, depending on the results of block 370 further discussed herein. In block 345, the input feature vector is forward propagated in the DNN. In block 350, the error between the predicted and oracle gains is calculated.

As also shown in FIG. 3, process 300 includes an additional flow path with blocks 360 to 370 which relate to the various blocks of FIG. 2. In block 360, the error (e.g., determined by block 350) is backward propagated (e.g., fed back as shown in FIG. 2 from block 250 to block 245) into the DNN and the various DNN weights are updated. In block 365, the error prediction is cross validated with the development dataset. In block 370, if the error is reduced, then the training continues (e.g., block 345 will be performed). Otherwise, the training stops and the process of FIG. 3 ends.

Figure 4:
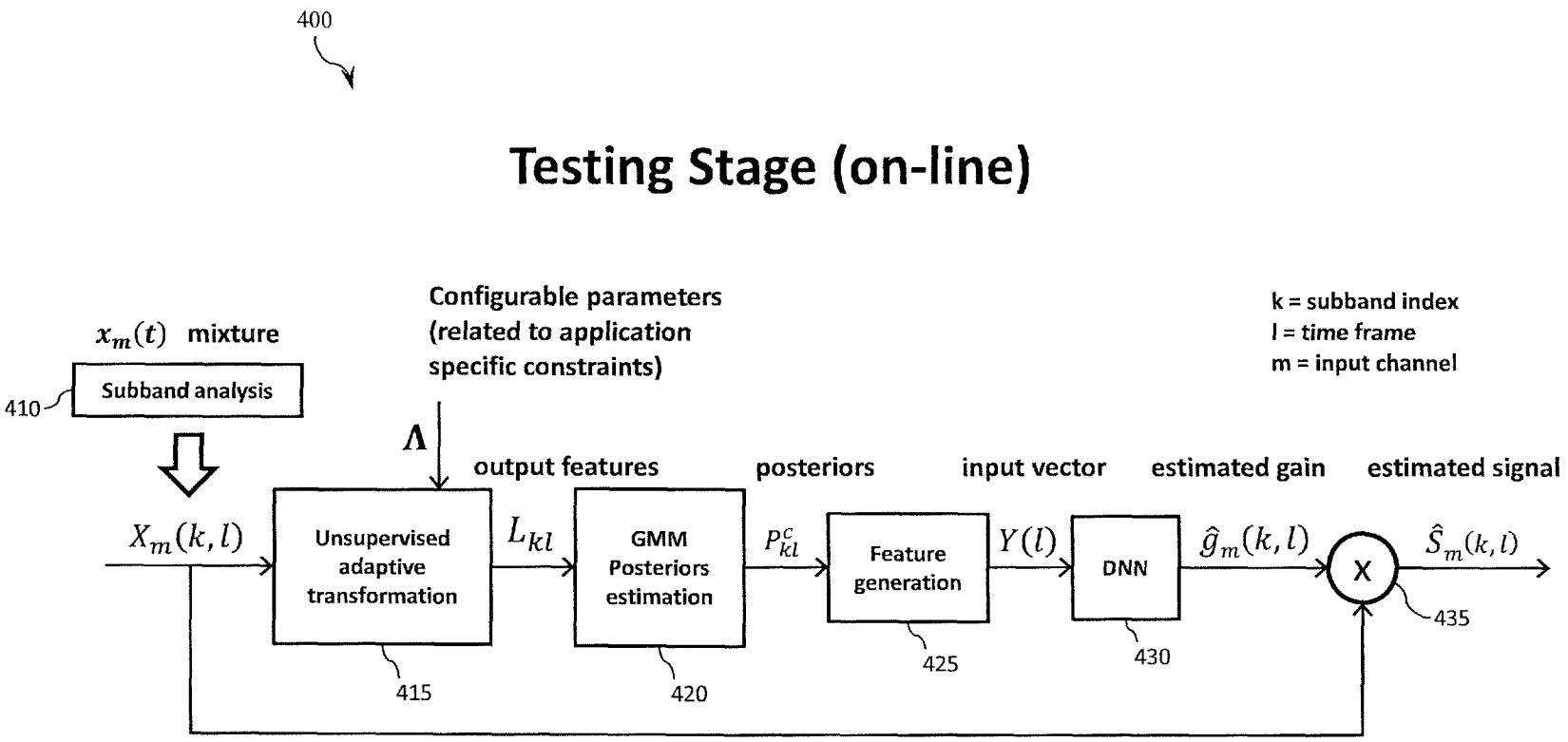
FIG. 4 illustrates a block diagram of a testing system in accordance with an embodiment of the disclosure.
Figure 5:
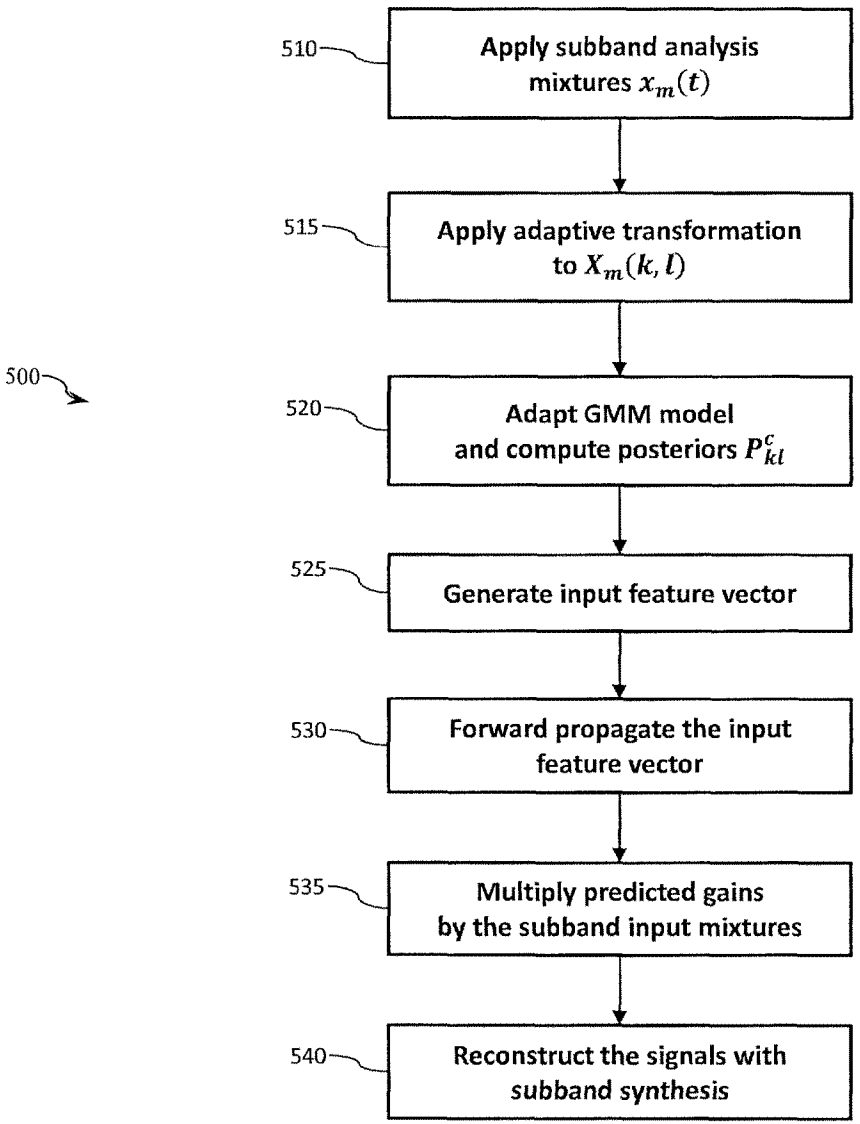
FIG. 5 illustrates a process performed by the testing system of FIG. 4 in accordance with an embodiment of the disclosure.

FIG. 4 illustrates a block diagram of a testing system 400 in accordance with an embodiment of the disclosure, and FIG. 5 illustrates a process 500 performed by the testing system 400 of FIG. 4 in accordance with an embodiment of the disclosure.

In general, the testing system 400 operates to define the application scenario and set the configurable parameters properly, transform the mixtures X(k,l) to L(k,l) through an adaptive filtering constrained by the configuration, estimate the posteriors $P_k^l$ through unsupervised learning, and build the input vector Y(l) and feedforward to the network to obtain the gain prediction.

Referring now to FIG. 4, as shown, the testing system 400 receives a mixture $x_m(t)$. In one embodiment, the mixture $x_m(t)$ is a multichannel, time-domain audio input signal, including a mixture of target source signals and noise. The testing system includes a subband analysis block 410, an unsupervised adaptive transformation block 415, a GMM posteriors estimation block 420, a feature generation block 425, a DNN block 430 (e.g., corresponding to DNN 100 in some embodiments), and a multiplication block 435 (e.g., which multiplies the mixtures by the estimated gains to provide estimated signals).

Referring now to FIG. 5, process 500 includes a flow path with blocks 510 to 535 generally corresponding to blocks 410 to 435 of FIG. 2, and an additional block 540. In block 510, a subband analysis is performed. In block 515, an adaptive transformation is applied. In block 520, a GMM model is adapted and posteriors are calculated. In block 525, the input feature vector is generated. In block 530, the input feature vector is forward propagated in the DNN. In block 535, the predicted gains are multiplied by the subband input mixtures. In block 540, the signals are reconstructed with subband synthesis.

In general, the various embodiments disclosed herein differ from standard approaches that use DNN for enhancement. For example, in traditional DNN implementations using magnitude-based features, the gain regression is implicitly done by learning atomic patterns discriminating the target source from the noise. Therefore, a traditional DNN is expected to have a beneficial generalization performance only if there is a simple separation hyperplane discriminating the target source from the noise patterns in the multidimensional space, without overfitting the specific training data. Furthermore, this hyperplane is defined according to the specific task (e.g., for specific tasks such as separating speech from noise or separating speech from speech).

In contrast, in various embodiments disclosed herein, discriminability is achieved in the posterior probabilities domain. The posteriors are determined at test time according to the model and the configurable parameters. Therefore, the task itself is not hard encoded (e.g., defined) in the training stage. Instead, a DNN in accordance with the present embodiments learns how to equalize the posteriors in order to produce a better spectral gain estimation. In other words, even if the DNN is still trained with posteriors determined on multiple tasks and acoustic conditions, those posteriors are more invariant with the respect to the specific acoustic conditions compared to the signal magnitude. This allows the DNN to have a improved generalization on unseen conditions.

Figure 6:
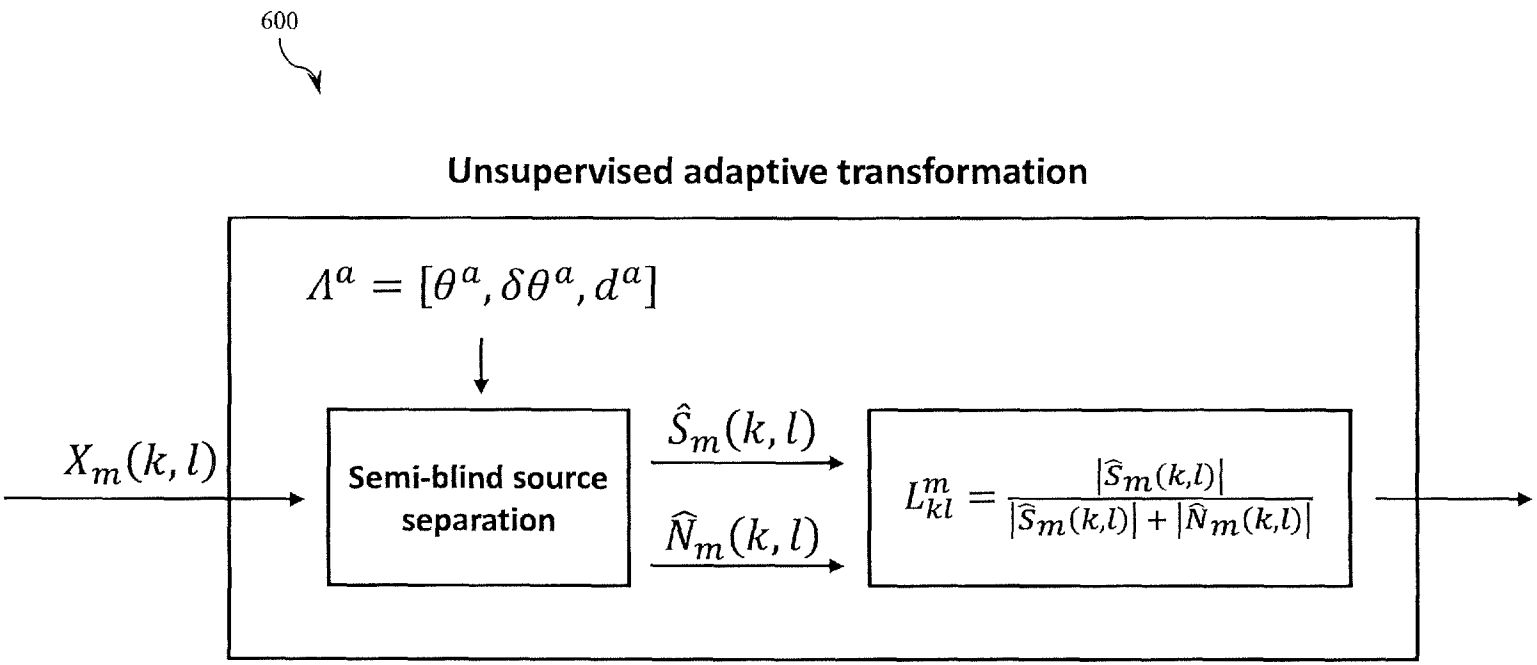
FIG. 6 illustrates a block diagram of an unsupervised adaptive transformation system in accordance with an embodiment of the disclosure.

FIG. 6 illustrates a block diagram of an unsupervised adaptive transformation system 600 in accordance with an embodiment of the disclosure. In this regard, system 600 provides an example of an implementation where the main goal is to extract the signal in a particular spatial location which is unknown at training time. System 600 performs a multichannel semi-blind source extraction algorithm to enhance the source signal in the specific angular region $[\theta^a-\delta\theta^a;\ \theta^a+\delta\theta^a]$, whose parameters are provided by $\Lambda^a$. The semi-blind source extraction generates for each channel m an estimate of the extracted target source signal $\hat{S}(k,l)$ and of the residual noise $\hat{N}(k,l)$.

System 600 generates an output feature vector, where the ratio mask is calculated with the estimated target source and noise magnitudes. For example, in an ideal sparse condition, and assuming the output corresponds to the true magnitude of the target source and noise, the output features $L_{kl}^m$ would correspond to the IBM. Therefore, in non-ideal conditions, $L_{kl}^m$ correlates with the IBM which is a necessary condition for the proposed adaptive system in some embodiments. In this case, $\Lambda^a$ identifies the parameters defined for a specific source extraction task. At training time, multiple acoustic conditions and parameterization for $\Lambda^a$ are defined, according to the specific task to be accomplished. This is generally referred to as multicondition training. The multiple conditions may be implemented according to the expected use at test time. The DNN is then trained to predict the oracle masks, with the backpropagation algorithm and by using the adaptive features $L_{kl}^m$. Although the DNN is trained on multiple conditions encoded by the parameters $\Lambda^a$, the adaptive features $L_{kl}^m$ are expected to be mildly dependent on $\Lambda^a$. In other words, the trained DNN may not directly encode the source locations but only the estimation error of the semi-blind source subsystem, which may be globally independent on the source locations but related to the specific internal model used to produce the separated components $\hat{S}(k,l)$, $\hat{N}(k,l)$.

Figure 7:
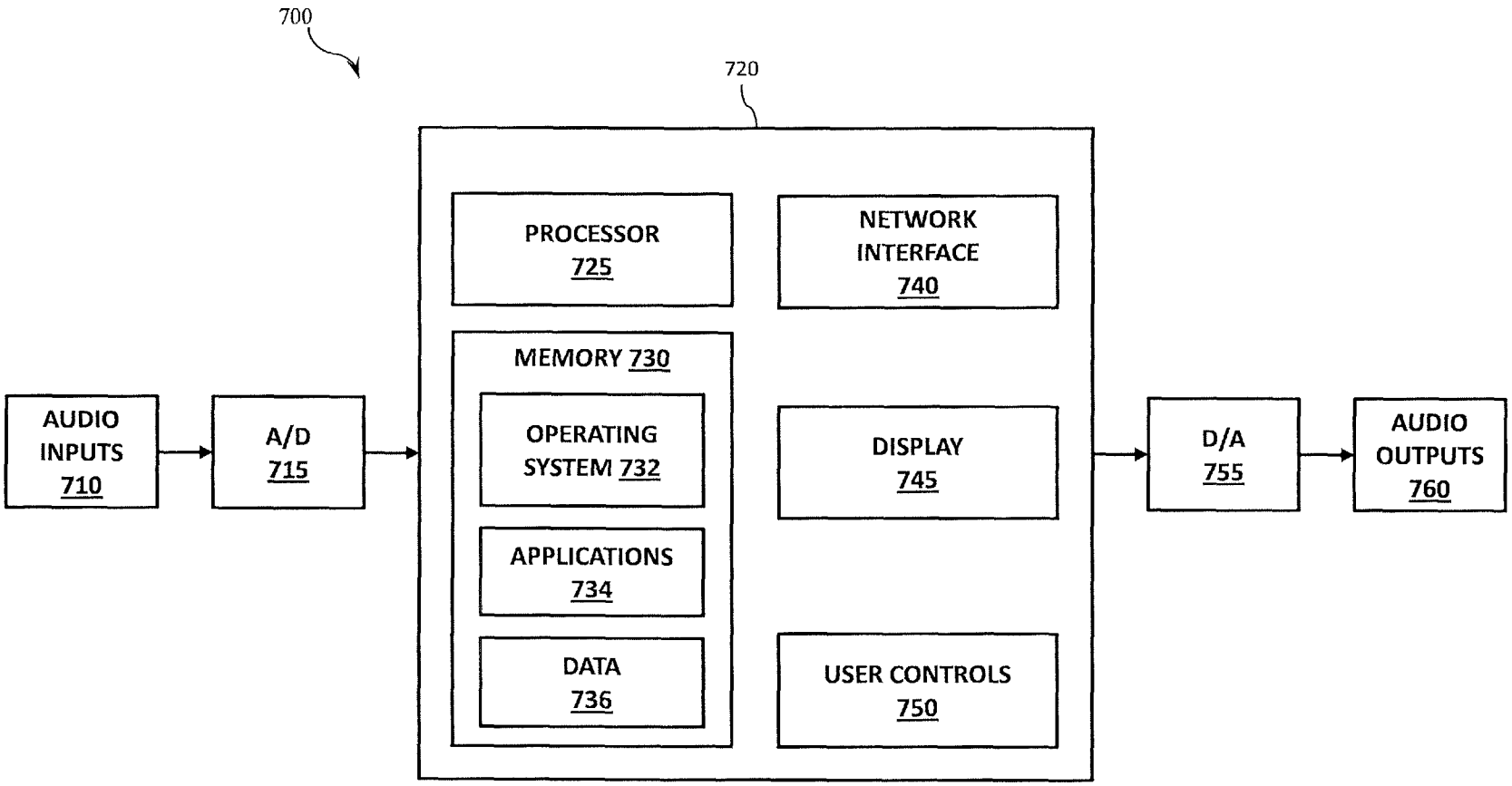
FIG. 7 illustrates a block diagram of an example hardware system in accordance with an embodiment of the disclosure.

As discussed, the various techniques described herein may be implemented by one or more systems which may include, in some embodiments, one or more subsystems and related components as desired. For example, FIG. 7 illustrates a block diagram of an example hardware system 700 in accordance with an embodiment of the disclosure. In this regard, system 700 may be used to implement any desired combination of the various blocks, processing, and operations described herein (e.g., DNN 100, system 200, process 300, system 400, process 500, and system 600). Although a variety of components are illustrated in FIG. 7, components may be added and/or omitted for different types of devices as appropriate in various embodiments.

As shown, system 700 includes one or more audio inputs 710 which may include, for example, an array of spatially distributed microphones configured to receive sound from an environment of interest. Analog audio input signals provided by audio inputs 710 are converted to digital audio input signals by one or more analog-to-digital (A/D) converters 715. The digital audio input signals provided by A/D converters 715 are received by a processing system 720.

As shown, processing system 720 includes a processor 725, a memory 730, a network interface 740, a display 745, and user controls 750. Processor 725 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), codecs, and/or other processing devices.

In some embodiments, processor 725 may execute machine readable instructions (e.g., software, firmware, or other instructions) stored in memory 730. In this regard, processor 725 may perform any of the various operations, processes, and techniques described herein. For example, in some embodiments, the various processes and subsystems described herein (e.g., DNN 100, system 200, process 300, system 400, process 500, and system 600) may be effectively implemented by processor 725 executing appropriate instructions. In other embodiments, processor 725 may be replaced and/or supplemented with dedicated hardware components to perform any desired combination of the various techniques described herein.

Memory 730 may be implemented as a machine readable medium storing various machine readable instructions and data. For example, in some embodiments, memory 730 may store an operating system 732 and one or more applications 734 as machine readable instructions that may be read and executed by processor 725 to perform the various techniques described herein. Memory 730 may also store data 736 used by operating system 732 and/or applications 734. In some embodiments, memory 220 may be implemented as non-volatile memory (e.g., flash memory, hard drive, solid state drive, or other non-transitory machine readable mediums), volatile memory, or combinations thereof.

Network interface 740 may be implemented as one or more wired network interfaces (e.g., Ethernet, and/or others) and/or wireless interfaces (e.g., WiFi, Bluetooth, cellular, infrared, radio, and/or others) for communication over appropriate networks. For example, in some embodiments, the various techniques described herein may be performed in a distributed manner with multiple processing systems 720.

Display 745 presents information to the user of system 700. In various embodiments, display 745 may be implemented as a liquid crystal display (LCD), an organic light emitting diode (OLED) display, and/or any other appropriate display. User controls 750 receive user input to operate system 700 (e.g., to provide user defined parameters as discussed and/or to select operations performed by system 700). In various embodiments, user controls 750 may be implemented as one or more physical buttons, keyboards, levers, joysticks, and/or other controls. In some embodiments, user controls 750 may be integrated with display 745 as a touchscreen.

Processing system 720 provides digital audio output signals that are converted to analog audio output signals by one or more digital-to-analog (D/A) converters 755. The analog audio output signals are provided to one or more audio output devices 760 such as, for example, one or more speakers.

Thus, system 700 may be used to process audio signals in accordance with the various techniques described herein to provide improved output audio signals with improved speech recognition.

Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice-versa. Embodiments described above illustrate but do not limit the invention. It should also be understood that numerous modifications and variations are possible in accordance with the principles of the present invention. Accordingly, the scope of the invention is defined only by the following claims.

What is claimed is:

1. A method for processing a multichannel audio signal including a mixture of a target source signal and at least one noise signal using unsupervised spatial processing and data-based supervised processing, the method comprising:

producing, by an adaptive transformation subsystem through a multichannel, unsupervised adaptive transformation process, an estimation of the target source signal and residual noise in each channel of the multichannel audio signal, and generating corresponding output features, wherein the output features comprise signal characteristics invariant to an acoustic scenario;

fitting, by an unsupervised adaptive Gaussian Mixture Model subsystem, the output features to a Gaussian Mixture Model and generating a plurality of posterior probabilities from the output features;

generating, by a feature generation subsystem, a feature vector by combining the posterior probabilities for different subbands and contextual time frames;

predicting spectral gains using a neural network trained to map the feature vector received as an input to the neural network to an oracle mask defined at a supervised training stage; and applying, by an estimated signal subsystem, the spectral gains to the multichannel audio signal to produce an estimate of an enhanced target source signal.

2. The method of claim 1 further comprising, transforming, by a subband analysis subsystem, time-domain audio signals to under-sampled K subband frequency-domain audio signals.

3. The method of claim 2 wherein the frequency-domain audio signals comprise a plurality of audio channels, each audio channel comprising a plurality of subbands, and wherein posterior probabilities are generated for each subband and discrete time frame.

4. The method of claim 2 further comprising reconstructing, by a subband synthesis subsystem, the time-domain audio signals from the frequency-domain signals, wherein the reconstructed time domain signal includes an enhanced target source signal and suppressed unwanted noise.

5. The method of claim 1 further comprising receiving, by a plurality of microphones, sound produced by the target source and at least one noise source and generating the multichannel audio signal.

6. The method of claim 1 wherein producing, by the adaptive transformation subsystem, further comprises performing an unsupervised multichannel adaptive feature transformation based on semi-blind source component analysis to produce an estimation of target and noise source components for each channel.

7. The method of claim 1 further comprising, receiving user-defined configuration parameters defining the acoustic scenario.

8. The method of claim 1 wherein the acoustic scenario comprises a conference modality in which multiple target speakers are extracted from background noise.

9. The method of claim 1 wherein the acoustic scenario comprises extraction of most dominant source localized in a spatial region.

10. The method of claim 1 wherein producing, by an adaptive transformation subsystem, further comprises estimating a signal-to-signal-plus-noise ratio.

11. The method of claim 1, further comprising defining a plurality of target oracle masks according to desired target signal approximation criteria at the supervised training stage; and wherein the oracle mask is one of the plurality of target oracle masks.

12. A machine-implemented method using unsupervised spatial processing and data-based supervised processing, the method comprising:

performing a subband analysis on a plurality of time-domain audio signals to provide a plurality of multichannel under-sampled subband signals, wherein the multichannel under-sampled subband signals comprise mixtures of target source signals and noise signals;

performing a multichannel, unsupervised adaptive transformation on the plurality of multichannel under-sampled subband signals to estimate for each subband signal a target source component and a residual noise component and generate corresponding output features representing characteristics of the audio signals invariant to specific acoustic scenarios;

adapting the output features to fit a Gaussian Mixture Model to generate a plurality of posterior probabilities;

combining the posterior probabilities to provide an input feature vector;

propagating the input feature vector through a pre-trained neural network to determine a plurality of estimated gain values for enhancing the target source signal;

applying the estimated gain values to the subband signals to provide gain-adjusted subband signals; and reconstructing a plurality of time-domain audio signals from the gain-adjusted subband signals to produce an enhanced target source signal.

13. The method of claim 12, wherein each of the time-domain audio signals is associated with a corresponding audio input.

14. The method of claim 13, wherein each audio input is associated with a corresponding microphone of an array of spatially distributed microphones configured to receive sound from an environment of interest.

15. The method of claim 12, wherein the unsupervised adaptive transformation maps the subband signals to a domain according to user specified configurable parameters.

16. The method of claim 12, wherein the unsupervised adaptive transformation is performed in accordance with a spectral gain function.

17. An audio signal processing system configured to process a multichannel audio signal using unsupervised spatial processing and data-based supervised processing, the audio signal processing system comprising:

an unsupervised adaptive transformation subsystem configured to identify features of the multichannel audio signal having values correlated to an ideal binary mask, through an online unsupervised adaptive learning process operable to adapt parameters to an acoustic scenario observed from the multichannel audio signal;

an adaptive modeling subsystem configured to fit the identified features to a Gaussian Mixture Model and produce posterior probabilities;

a feature vector generation subsystem configured to receive the posterior probabilities and generate a neural network feature vector;

a neural network configured to predict spectral gains from a mapping of the neural network feature vector to an oracle mask defined at a supervised training stage; and a spectral processing subsystem configured to produce an estimate of target source time-frequency magnitudes from the multichannel audio signal and the predicted spectral gains output by the neural network.

18. The audio signal processing system of claim 17 further comprising:

a subband analysis subsystem configured to transform multi-channel time-domain audio input signals to a plurality of frequency-domain subband signals representing the audio signal; and a subband synthesis subsystem configured to receive the output from the spectral processing subsystem and transform the subband signals into the time-domain.

19. The audio signal processing system of claim 17 wherein the adaptive transformation subsystem is further configured to receive user-defined parameters relating to defined acoustic scenarios.

* * * * *